United States Patent [19]

Cooley

[11] 4,311,343

[45] Jan. 19, 1982

[54] APPARATUS FOR BREAKING ROCK OR CONCRETE

[75] Inventor: William C. Cooley, Bethesda, Md.

[73] Assignee: Terraspace, Inc., Rockville, Md.

[21] Appl. No.: 143,957

[22] Filed: Apr. 25, 1980

[51] Int. Cl.[3] ..... E21C 37/02; E21C 37/06

[52] U.S. Cl. ..... 299/22; 299/15; 175/267

[58] Field of Search ..... 299/15, 21–23; 175/267; 125/23 R, 23 C

[56] References Cited

U.S. PATENT DOCUMENTS

| | | | |
|---|---|---|---|
| 900,003 | 9/1908 | Veitch | 299/23 |
| 3,727,599 | 4/1973 | Sugiki et al. | 125/23 R |
| 4,099,784 | 7/1978 | Cooper | 299/22 X |

FOREIGN PATENT DOCUMENTS

| | | | |
|---|---|---|---|
| 33791 | 5/1948 | Poland | 299/20 |
| 17618 | of 1887 | United Kingdom | 299/22 |

*Primary Examiner*—Ernest R. Purser
*Attorney, Agent, or Firm*—Edwin E. Greigg

[57] ABSTRACT

A method of breaking rock, concrete or other hard compact material adjacent to a hole drilled thereinto and an apparatus for performing the method wherein the apparatus contains a notch-forming means to form a circumferential notch in the drillhole wall, a hydraulic jack means which is located inside the drillhole to exert a force to actuate the notch-forming means and to react against the bottom of the drillhole and develop an outwardly directly axial force on the notcher to break one or more pieces of material from the face and a hydraulic supply means to supply hydraulic fluid to actuate the hydraulic jack. The hydraulic supply means is located outside the drillhole.

5 Claims, 3 Drawing Figures

APPARATUS FOR BREAKING ROCK OR CONCRETE

The U.S. Government has rights in this invention pursuant to Contract DAR 78-21038 dated Mar. 1, 1979 by the national Science Foundation.

CROSS-REFERENCE TO PRIOR ART DISCLOSURES AND REFERENCES

There are no prior art disclosures nor anticipatory references. Of interest are several prior art disclosures including the following:

| | |
|---|---|
| German No. | 389,750 |
| Swiss No. | 286,398 |
| French No. | 1,285,370 |
| German No. | 1,427,709 |
| USSR | 259,010 |
| U.S. Pat. No. (Cooper, George A.) | 4,099,784 |

In U.S. Pat. No. 4,099,784 (also Swiss Pat. No. 598,472 and U.K. Pat. No. 155 0850) there is contained a review of patent literature and description of a method and apparatus for breaking hard compact material such as rock. None of the devices described in that patent nor in the German, Swiss, French or Russian patents discussed therein utilize a hydraulic jack within the drillhole nor a notch-forming element to initiate a single circumferential crack substantially normal to the drillhole axis.

In U.S. Pat. No. 4,099,784, it is stated that controlling the radial outwardly directed gripping force and the axial acting force independently from one another "is indispensable for a satisfactory breaking of rock and the like". However, this invention provides a scheduled and controlled relationship between radial and axial forces during the fracture and removal process.

BRIEF SUMMARY OF THE INVENTION

The invention relates to a method and apparatus for breaking rock, concrete or other hard compact material adjacent to a hole drilled thereinto. A region of the material disposed around the drillhole is contacted by a circumferential notcher element which initiates a crack substantially normal to the hole axis when a force is applied to the notcher by a cone surface on the hydraulic jack within the drillhole. Actuation of said hydraulic jack applies force to the notcher to extend said crack and thereby to remove material from the face. Said hydraulic jack develops force by reaction against the bottom of the drillhole when it is supplied by hydraulic fluid from an external supply means.

The method can be applied in driving tunnels, quarrying rock, mining, breaking boulders and so on.

In the present invention is provided a means for developing a radial notching force which is directly proportional to the axial removal force, up to a certain maximum radial displacement of the notcher. Thereafter, the radial force does not increase as the axial force increases, thereby limiting the possible axial splitting of the material which could cause the notcher to slip. The limiting value of radial displacement of the notcher may be adjusted for various types of rock by insertion of ring shaped shims between a shoulder on the jack cylinder and the end of the notcher, or by using a notcher of different dimensions.

SUMMARY OF THE INVENTION

A method for breaking rock, concrete or other hard compact material characterized by drilling a hole therein, then inserting a means for forming a circumferential notch and generating within the drillhole an axial removal force with the notcher blade element to crack a material from the face. The apparatus to carry out this method comprises a hydraulic jack means which is located in the drillhole and acts against the bottom of the hole, a notcher blade element which is expanded and moved axially outward by a conical surface on the outer end of the hydraulic jack, and a hydraulic supply means to supply hydraulic fluid to the hydraulic jack. The notcher blade element consists of a generally large single turn screw thread on the circumference of the split tube notcher so that it can be threaded (by hand or otherwise) into the rock to prevent slipping and to develop an initial axial friction load. Then the hydraulic jack is actuated to drive its conical suface against the internal conical surface of the split-tube notcher and thereby to expand the notcher blade radially into the rock. When the cone on the jack reaches the limit of its motion, a shoulder engages the inner end of the notcher and the full jack force then acts to break a section of rock from the face. The section of rock removed from a homogeneous material can be axi-symmetric and shaped roughly like a cone, wafer or head of a mushroom. In some cases, the "cone" may split radially into two or more pie-shaped segments. This may sometimes be undesirable if it results in axial slipping of the notcher in the hole. Splitting can be avoided by adding shim rings between the shoulder on the hydraulic jack and the end of the notcher to limit the radial displacement of the notcher. In most cases the notcher blade will not penetrate the rock to its full radial blade height so that the split-tube fingers do not actually contact the surface of the drillhole. The gripping action is accomplished by the notcher blade and not by friction of the tube on the cylindrical surface.

BRIEF DESCRIPTION OF THE DRAWINGS

The above and other objects and advantages of the invention will become apparent upon full consideration of the following detailed description and accompanying drawings in which.

DETAILED DESCRIPTION OF A PREFERRED EMBODIMENT

Figure 1:
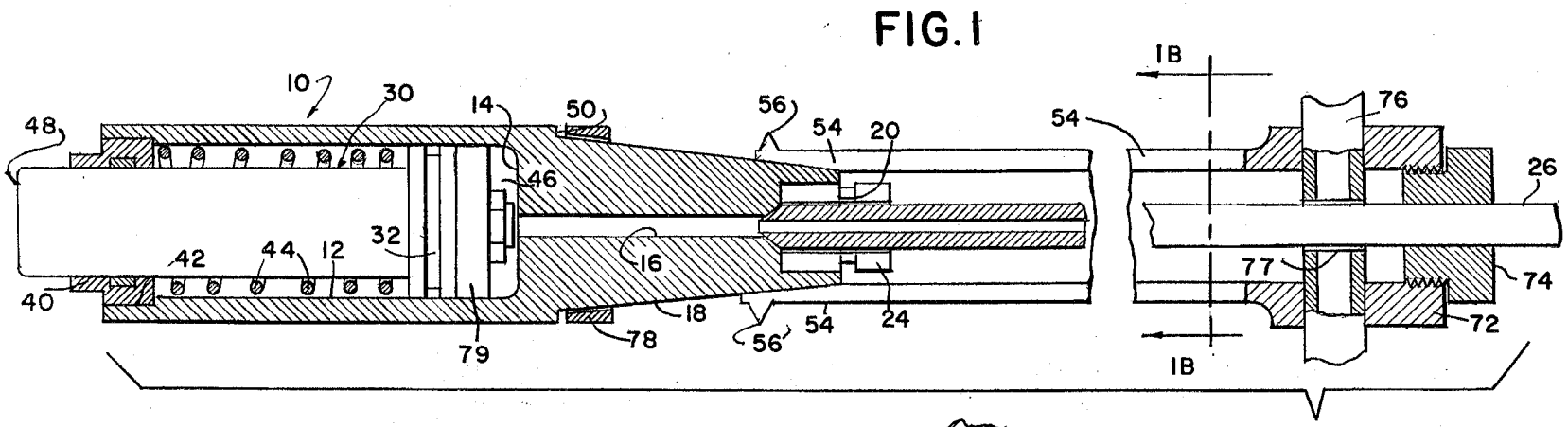
FIG. 1 is a schematic and cross-sectional view of an apparatus for breaking rock from the region around a pre-drilled hole.

Referring now to the drawings there is shown a hydraulic cylinder housing 10 having a cylindrical hollow space 12 therein terminating at an interior end wall 14 in which there is an axially disposed channel 16 extending therethrough and continuing through a conical or conic shaped extension of the hydraulic cylinder 10 as shown in FIG. 1.

The conic shaped extension 18 has a taper that is configured such that the diameter is reduced in ratio essentially and substantially as is shown and terminates at an end in the surface 20. The end surface 20 has a recess into which there is a fitting 24 for retaining in fixed location a hydraulic fluid supply line or tube 26 that is of sufficient length that it extends to a hydraulic supply source (not shown) of conventional construction for providing fluid under substantive pressure values through the hydraulic fluid supply line 26 and to the hydraulic chamber 12.

Figure 2:
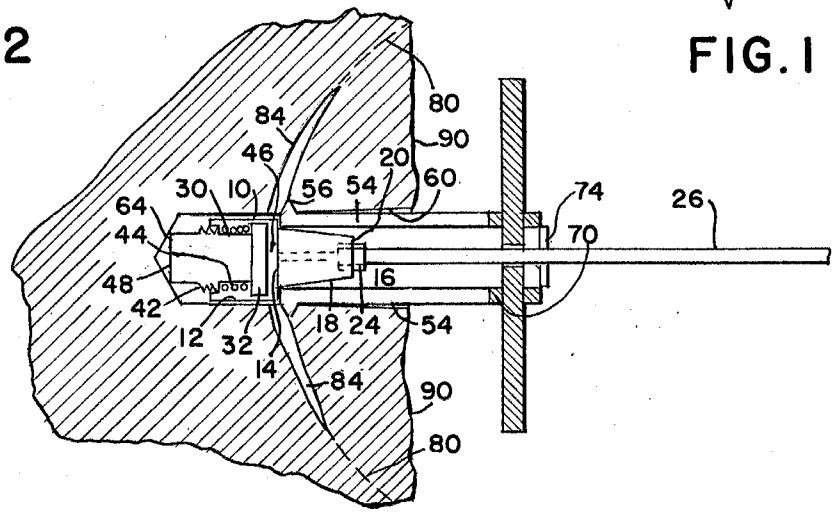
FIG. 2 is a schematic and cross-sectional view of an apparatus located in a drillhole in the process of breaking a cone of rock from a rock face.
Figure 1B:
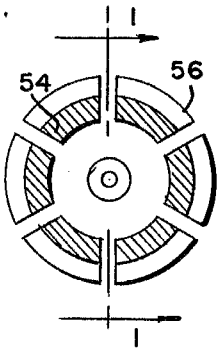
FIG. 1B is a cross-sectional view taken along line 1B-1B of FIG. 1.

Also shown in FIG. 1 as well as in FIG. 2 is a hydraulic cylinder piston 30 having a piston head 32 for providing surface contact to the interior wall of the hydraulic chamber 12 in conventional piston-chamber relationship, and as is shown.

An open end of the cylindrical chamber 12 has a hydraulic cylinder cap and wiper arrangement 40 which is threadedly or otherwise securedly affixed to the interior wall surface extension 42. The cylindrical cap and wiper arrangement 40 retains a tension or bias spring 44 in place and of itself returns or tends to return the piston head 32 to the interior end wall 14 unless such spring pressure and tension is overcome by hydraulic fluid pressure directed into the chamber 46 that communicates with the hydraulic fluids supplied to 26. The piston rod 30 communicates with an interior of the cylinder cap and wiper arrangement 40 which is shown with structural arrangements for being guided in axial alignment with the hydraulic cylinder and chamber 12, 46.

As is shown, there is a shoulder 50 that separates the hydraulic cylinder body 10 from the conic shaped extension 18 and upon the conic shaped extension 18 there is provided a split tube notcher elements 54, 54 for matingly engaging the surface of the conic shaped extension 18 as shown. The end of the split tube notcher 54, 54 terminates in blade or blades 56, 56 which are used to be applied to the interior surface walls of a rock, cement structure or other pre-drilled type hole 60 shown in FIG. 2 which extends into the rock material to an end wall 64. The construction of the split tube notcher 54 may rotate about the centerline of tube 26. Into the free end 72 of split tube notcher 54 there is threadedly engaged a plug 74 with an axial cylindrical opening to serve as a bearing for rotation around tube 26. Passing through the free end 72 is a rod or handlebar 76 with opening 77 which is constructed of conventional type steel tubing and used for extending or positioning the split tube notcher 54,54 onto the larger radius surface of the conic shaped extension 18 until the blades 56, 56 engage the surface wall 60 shown in FIG. 2.

The process of the invention operates by inserting the hydraulic cylinder into the drill hole 60 with the piston 30 in its retracted position and the piston rod adjacent the interior end wall 14. The hydraulic jack and cylinder 10 is inserted sufficiently deep into the hole or opening 60 so that the piston end 48 contacts and rests against the bottom of the hole as shown in FIG. 2. The split tube notcher 54, 54 slides freely upon the smaller end of the surface of conic shaped extension 18 so that the blades 56,56 engage into the hole wall 60. The split tube notcher 54,54 is rammed against the conic shaped extension 18 and is rotated to self thread the notcher blade into the rock of the hole 60 to hold the notcher in place with respect to the axial relationship. The notcher blade 56, 56 may be at a typical depth of 10 to 40 centimeters from the exterior open rock face 90,90 extended on each side of the opening 60 of FIG. 2. At this point of the operation a high pressure hydraulic fluid from a source (not shown) is supplied and furnished through the supply tube 26 of the hydraulic jack apparatus 10 and the cone surface 18 of the conic shaped extension is forced against the split tube notcher fingers 54, 54 expanding notcher baldes 56, 56 into the rock so the notcher blade cuts into the rock and makes a circumferential notch until in the limit the shoulder of the cylinder 50 contacts the ends of the notcher blade 56, 56. By this operation the force of the jack 10 first acts to expand the blades 56, 56 against the rock causing a generally circular crack 84, 84 and enlarging in response to the expansion of the jack 10 and the blades 56, 56 into the crack 84, 84. In the limit, the cone extension 18 is stopped from extending into and spreading the notcher fingers 54, 54 by:

1. contact of notcher fingers 54, 54 with the walls of the opening 60, or
2. contact of shoulder of the cylinder 50 with the ends of the notcher blade 56, 56 or
3. contact of shoulder of the cylinder 50 with one or more circular ring shims 78 which may optionally be installed to separate shoulder 50 from the ends of the notcher blade 56, 56.

After relate motion between conic surface 18 and notcher fingers 54 has ceased, further supply of high pressure hydraulic fluid through tube 26 causes the full force of the hydraulic cylinder to be applied in an axial direction through notcher blades 56, 56 against the rock, thereby extending crank 84, 84 and removing a portion of the rock or wall 80 by forming a "cone" ("flake" or "mushroom") of the rock as illustrated in FIG. 2 shown in cross section.

When the rock is thus broken away from the surface wall 90 and is thereupon removed, the fluid pressure applied to the tube 26 is reduced to zero and the notcher blades 56, 56 are relaxed to their initial position so that the notcher 54, 54 and the jack 10 can be pulled out of the drillhole through the "cone" 80. Then the device can be reinserted within the wall 90 at either another location or to a greater depth within a redrilled or rebored hole 60 of the same drillhole in the rock face and the process is then repeated.

By the means of the present invention it is seen that a new and improved as well as substantially effective removal of rock portions from a wall or rock mass is achieved because radial forces, for example, which are applied to the gripper or blades need not be an appreciable fraction of the axial force applied to the rock. Gripping does not depend therefore no friction but rather on the presence of the circumferential notcher, having a triangular ridge or blade which can apply compressive stresses against the rock in an outward direction. The radial load is limited in a split tube notcher and gripper arrangement such as shown in FIGS. 1 and 2. Since the gripping action of the notcher does not depend on friction, the radial load need not be significantly high, thus saving the expenditure of work as well as avoiding axial splitting of rock due to excessive radial expansion. By preventing axial splitting, the possibility of axial slipping of the notcher blades is avoided.

In this device of the invention the radial expansion of the notcher blades is limited by the presence of a shoulder on the hydraulic cylinder. A shim 78 on the shoulder 50 permits adapting the device to the desired radial displacement of the notcher blade for a particular type of rock. In most rock formations, only the notcher blade (a single-turn screw thread) may contact the rock, so that there is no contact between the split-tube fingers and the rock, decreasing the chances of splitting rock parallel to the axis. The radial load is proportional to the axial load until a certain limit is reached for the radial load. Thereafter, the axial load can vary as needed.

Additional embodiments of the invention in this specification will occur to others and therefore it is intended that the scope of the invention be limited only by the appended claims and not by the embodiments described hereinabove. Accordingly, reference should be made to the following claims in determining the full scope of the invention.

What is claimed and desired to be secured by Letters Patent of the United States is:

1. Apparatus for breaking hard compact material such as rock adjacent a hole drilled thereinto comprising an expandable notcher member means carrying at one end a single turn, screw-threaded member of high strength metal to serve as a notch forming element and terminating at the other end in a rotatable cylindrical member having an opening therein, power or manual means received in said opening for self-threading said notcher means into the rock developing a small axial resistance, hydraulic jack means located within a drillhole for reacting against the hole bottom to drive a cone surface against the notcher means to expand the screw-threaded notcher means into the rock, and means applying axially disposed outward force through the notcher means against the rock for causing a portion of rock to be broken free.

2. Apparatus of claim 1 wherein hydraulic fluid supply means supplies a liquid under pressure to the hydraulic jack to cause it to be actuated.

3. Apparatus of claim 1 wherein spring means in the hydraulic jack means returns the piston when the hydraulic fluid is vented to return to a reservoir in preparation for another cycle.

4. Apparatus of claim 1 wherein said power or manual means is a handlebar for aiding the positioning of the notcher means onto the cone surface until the screw-threaded member engages a surface wall of said rock and asserting the small axial resistance thereagainst.

5. Apparatus of claim 1 wherein said expandable notcher means is a split-tube structure extending throughout its length except for terminating at the cylindrical member.

* * * * *